US011280340B2

(12) United States Patent
Stones et al.

(10) Patent No.: US 11,280,340 B2
(45) Date of Patent: Mar. 22, 2022

(54) VARIABLE INLET CONDUCTANCE VACUUM PUMP, VACUUM PUMP ARRANGEMENT AND METHOD

(71) Applicant: Edwards Limited, Burgess Hill (GB)

(72) Inventors: Ian David Stones, Burgess Hill (GB); Christopher Mark Bailey, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 199 days.

(21) Appl. No.: 16/504,985

(22) Filed: Jul. 8, 2019

(65) Prior Publication Data

US 2020/0011335 A1 Jan. 9, 2020

(30) Foreign Application Priority Data

Jul. 9, 2018 (GB) ..... 1811228

(51) Int. Cl.
*F04D 19/04* (2006.01)
*F04D 25/08* (2006.01)
(Continued)

(52) U.S. Cl.
CPC ..... *F04D 19/042* (2013.01); *F04D 19/046* (2013.01); *F04D 19/048* (2013.01);
(Continued)

(58) Field of Classification Search
CPC .... F04D 19/042; F04D 19/046; F04D 19/048; F04D 25/0606; F04D 25/08; F04D 27/002; F04D 29/052; F04D 29/524
(Continued)

(56) References Cited

U.S. PATENT DOCUMENTS 4,926,648 A * 5/1990 Okumura ..... F04D 19/046 62/55.5
5,662,456 A * 9/1997 Englander ..... F04D 29/668 415/90
5,695,316 A * 12/1997 Schutz ..... F04D 17/168 415/143
(Continued)

FOREIGN PATENT DOCUMENTS

EP 0893604 A1 1/1999
EP 0898081 A1 * 2/1999 ..... F04D 19/04
(Continued)

OTHER PUBLICATIONS

Examination Report dated Jan. 9, 2019 and Search Report dated Jan. 8, 2019 for corresponding British application Serial No. GB1811228.4.

*Primary Examiner* — Alexander B Comley
(74) *Attorney, Agent, or Firm* — Theodore M. Magee; Westman, Champlin & Koehler, P.A.

(57) ABSTRACT

A vacuum pump, vacuum pump arrangement and method are disclosed. The vacuum pump includes at least one rotor; and a stator, an inlet for receiving gas during operation; and an exhaust for exhausting the gas. The vacuum pump includes a shaft extending through a centre of said pump and comprising a plate mounted on an end of the shaft towards the inlet. The vacuum pump includes control circuitry configured to control an axial position of the plate, a change in axial position of the plate providing a change in inlet conductance of gas to the vacuum pump. The plate is mounted such that it extends beyond the inlet in at least some axial positions of the rotor such that the plate is not on the same side of the inlet as the stator.

18 Claims, 6 Drawing Sheets

(51) Int. Cl.
*F04D 25/06* (2006.01)
*F04D 29/52* (2006.01)
*F04D 27/00* (2006.01)
*F04D 29/052* (2006.01)

(52) U.S. Cl.
CPC ..... *F04D 25/0606* (2013.01); *F04D 25/08* (2013.01); *F04D 27/002* (2013.01); *F04D 29/052* (2013.01); *F04D 29/524* (2013.01)

(58) Field of Classification Search
USPC ..... 417/295, 423.4
See application file for complete search history.

(56) References Cited

U.S. PATENT DOCUMENTS 6,019,581 A * 2/2000 von Schulz-Hausmann ..... F04D 19/04 417/368
6,062,810 A * 5/2000 Miyamoto ..... F04D 27/0253 415/90
6,186,749 B1 * 2/2001 Bouille ..... F04D 19/04 417/295
6,217,278 B1 * 4/2001 Shiokawa ..... F04D 17/168 415/90
6,220,831 B1 * 4/2001 Shiokawa ..... F04D 29/524 417/423.4
6,709,228 B2 * 3/2004 Stuart ..... F04D 19/042 415/191
6,966,967 B2 * 11/2005 Curry ..... F04D 19/04 156/345.26
7,140,847 B2 * 11/2006 Boger ..... F04B 37/14 417/296
7,600,989 B2 * 10/2009 Bohm ..... F04D 19/046 417/423.4
8,513,839 B1 * 8/2013 Larson ..... H02K 7/14 310/58
2006/0099094 A1 * 5/2006 Schofield ..... F04D 19/046 417/423.4
2018/0023719 A1 1/2018 Nakamura et al.

FOREIGN PATENT DOCUMENTS

EP 0898081 A1 2/1999
FR 1576465 8/1969
JP 2013167207 A * 8/2013 ..... F04D 29/524
WO 2004001230 A1 12/2003

* cited by examiner

VARIABLE INLET CONDUCTANCE VACUUM PUMP, VACUUM PUMP ARRANGEMENT AND METHOD

CROSS-REFERENCE OF RELATED APPLICATION

This application claims priority of British Application No. 1811228.4, filed Jul. 9, 2018, the content of which is hereby incorporated by reference in its entirety.

FIELD

The field of the invention relates to a vacuum pump, vacuum pump arrangement and method.

BACKGROUND

The semiconductor industry continues to need reduced sized components whilst the flow rates and power demands are increasing. Space under the chamber is at a premium. Chemistry is becoming more complex as 3-D structures need to be deposited and etched. This creates challenges in keeping vacuum pumps clean and reliable. Faster chamber pressure control whilst reducing particle generation and shedding is also desired.

Traditional pressure control of semiconductor and other process chambers is achieved by varying the opening of either a valve which is typically a butterfly valve or a pendulum valve. Where the process uses a turbo pump the pressure control valve is a pendulum valve between the chamber exhaust and the turbo inlet. Where the process does not use a turbo the pressure control valve is often a butterfly valve in the vacuum line from the chamber exhaust.

Etch processes typically uses turbo pumps. CVD (chemical vapour deposition) and ALD (atomic layer deposition) processes typically do not use turbos—there are exceptions such as HDPCVD (high density plasma chemical vapour deposition). The industry is now developing hybrid processes with both etch and ALD in the same chamber, potentially with recipes alternating between the two. ALE (atomic layer etch) is an emerging technique. Processes combining ALE and ALD are in development.

This suggests that turbo pumps will be used on processes that require rapid changes of pressure from those suitable for ALE to those suitable for ALD.

Any atomic layer process, whether ALE or ALD works by alternately flowing gas species into the chamber to react with the substrate but not with each other in the gas phase. This therefore requires intermediate steps to purge and/or evacuate the process chamber to clear out all of the preceding gas before admitting the second gas.

A process chamber with a turbo pump will be required to alternate quickly between pressures suitable for etch, deposition and purge/evacuation. The pressure change response time will affect process tool wafer throughput. The pressure changes are much greater than is currently experienced in traditional etch processes that use turbos.

At the same time, the industry requires greater precision and repeatability of all process parameters. Wafer to wafer consistency and chamber to chamber matching is important, requiring ever increasing levels of precision of pressure measurement and control.

The discussion above is merely provided for general background information and is not intended to be used as an aid in determining the scope of the claimed subject matter.

The claimed subject matter is not limited to implementations that solve any or all disadvantages noted in the background.

SUMMARY

A first aspect provides, a vacuum pump comprising: at least one rotor; and a stator; an inlet for receiving gas during operation; and an exhaust for exhausting said gas; wherein said vacuum pump comprises a shaft extending through said pump and comprising a plate mounted on an end of said shaft towards said inlet; said vacuum pump comprising control circuitry configured to control an axial position of said plate, a change in axial position of said plate providing a change in inlet conductance of gas to said vacuum pump; wherein said plate is mounted such that it extends beyond said inlet in at least some axial positions of said shaft such that said plate is not on the same side of said inlet as said stator.

There is an increasing need, particularly in the semiconductor industry, for vacuum pumps that can provide faster pressure control and reduced particle generation and shedding. There is also an increasing desire for reduced sized pumps. In the semiconductor fabrication industry for example, the available space around the vacuum chamber inside a clean room is extremely limited.

Aspects of the invention seek to address these competing requirements by providing a pump having a plate on an end of a shaft, axial movement of the plate providing inlet conductance control. This provides an effective and fast control of the inlet conductance to the pump and thus, of the pressure supplied by the pump, enabling an effective control of the pressure in a chamber with reduced space and component requirements.

The plate at least partially obscures the inlet and its movement causes the inlet conductance to vary as the gas flows around the edge of the plate. In some cases, the plate may extend beyond the pump's inlet in all axial positions while in others it may extend beyond the inlet in some axial positons. Axial movement, is movement substantially parallel to the shaft of the pump.

It should be noted that the plate may be a substantially flat element with a circular cross section, it may also other forms such as a conical shape.

The shaft extends through the pump from a location at or close to an exhaust end to a location at or close to an inlet end and may extend through the centre of the pump and may have impellers such as blades or plates mounted on it. The shaft may be mounted to rotate or may be mounted not to rotate. If the shaft is not mounted for rotation the impellers may be termed fixed, impellers although they will move axially with the shaft.

In some embodiments, said plate is configured to close said inlet at a predefined axial position.

The plate is moved axially towards and away from the inlet thereby varying the degree of obstruction of the inlet and thus, the inlet conductance. In some cases the rotor plate may be configured at a predefined axial position to completely obscure the inlet and close it.

In some embodiments, said shaft comprises a rotor shaft, said plate comprising a rotor plate being configured to rotate with said rotor In some embodiments, where the plate is a rotor plate and is rotating with the rotor then it may be advantageous to provide the plate with surface irregularities on a surface facing towards said inlet, said surface irregularities being configured to divert at least some particles within said gas towards said inlet.

Providing a spinning plate adjacent to the pump inlet with surface irregularities on the surface facing the inlet, provides the possibility of diverting particles hitting these irregularities towards the inlet. This will increase the probability of particles being directed through the inlet and increase the efficiency of the pump. Such a profile may have a number of forms for example it may be a spiral with a saw-tooth profile where perhaps the rotational direction of the spiral reverses towards the centre.

In other embodiments, said rotor comprises an outer cylinder comprising impellers and said stator comprises said shaft to which are mounted fixed impellers.

In some embodiments, the rotor or rotating portion of the pump is not the central portion but the outer portion, the central portion being the fixed portion. In such a case the shaft therefore the plate will not rotate. This may have advantages in that rotating movement of an element within the chamber is removed.

In some embodiments, said vacuum pump comprises a turbo pump stage backed by a backing stage such as a drag and/or regenerative stage.

A turbo pump is an effective pump for providing a high vacuum. A turbo pump has fixed and rotating blades with some clearance between the blades. The closeness of the blades to each other does not greatly affect the pumping efficiency of the pump and the blades are generally set to the mid-point to reduce the possibility of accidental clashes. Thus, for a turbo pump some change in axial position of the rotor relative to the stator will not affect the pumping efficiency greatly. However, where a plate is mounted on the rotor adjacent to the pump inlet such axial movement can be used to vary inlet conductance in a very effective manner.

In some embodiments, said turbo and at least one further stage are mounted on a same shaft.

Where the turbo and further stage are mounted on a same shaft then any relative axial movement between the rotor and stator will be felt by both stages. Where the pumping capacity provided by the at least one further stage is affected by the relative axial positon of the rotor and stator then in such an embodiment both stages will provide an effect on the pumping capacity. Thus, larger changes in pumping capacity can be achieved with the same relative movement.

In other embodiments, said turbo and said at least one further stage are mounted on different shafts, said turbo stage comprising said rotor plate.

In other cases the stages may be mounted on different shafts. There are advantages for mounting the stages on different shafts. They may be made of different materials, and thus, run at different temperatures, which may be helpful in avoiding deposition of particles in the lower pressure pump. Any axial control of the two stages can also be performed independently which may also have advantages. The axial length of the combined pump is also reduced which may make their accommodation under a process chamber for example easier. There are of course also some disadvantages such as an increased number of bearings and driving mechanisms In some embodiments, said rotor is mounted to be movable in an axial direction with respect to said stator.

Axial movement of the plate may be achieved by moving the whole pump relative to a chamber outlet or where the plate is fixed on the rotor it may be achieved by moving the rotor in an axial direction with respect to the stator.

In some embodiments, said rotor is positioned within said pump via electro-magnetic bearings, and said control circuitry is configured to control an axial position of said rotor by controlling a current supplied to electro-magnets associated with said bearings.

Some pumps, particularly turbo pumps have magnetically levitated rotors and therefore have some control of the axial position of the rotor. This magnetic levitation is used to allow the turbo pump to rotate at high speed with low friction and without the need for lubricants which may contaminate the vacuum. Conventionally control of the magnetic levitation is used to set the position of the rotor relative to the stator at an optimum or preferred point that may be selected either as the mid-point between the blades to maximise clearances and reduce the chances of blades clashing, or where axial clearances affect pumping efficiency, where for example the turbo pump is backed by a Siegbahn drag stage mounted on the same shaft, at a point that provides greatest pumping efficiency. Where the plate is a rotor plate, embodiments seek to provide this axial control not to provide one selected preferred position of the rotor but rather to provide a choice of different axial positions to provide different inlet conductance and in some cases pumping capacities allowing the axial position to be used in control of the pressure generated by the pump. Control of axial positon can in this way be used to provide rapid changes in pressure produced in a chamber by such a pump, without the need for many additional parts allowing the pump to retain a low size, relatively low cost and not have an increase in servicing requirements. Thus, a cost effective and efficient means of controlling pressure generated by the pump is achieved.

In some embodiments, said at least one further stage comprises a drag stage and in some embodiments a Siegbahn stage, said rotor comprising at least one rotating plate and said stator comprising at least one fixed plate, a distance between said at least one rotating plate and said at least one fixed plate being dependent upon said relative axial position of said stator to said rotor.

As noted previously, moving the rotor axially with respect to the stator in a turbo pump does not greatly affect the efficiency of the turbo pump but where a rotor plate is used it can be used to control inlet conductance of the pump. However, where the turbo pump is backed by a drag and/or regen stage then it may be that the axial movement of the rotor relative to the stator does affect pumping efficiency. In this regard, where the drag stage is for example a Siegbahn stage then the distance between the rotating and the fixed plates affects the pumping efficiency as the ratio of the fluid that is dragged forward to that which leaks back changes with distance between the plates. This change in pumping efficiency leads to a change in pumping speed and throughput and thus, in pumping capacity.

In some embodiments, at least one face of said plates of the Siegbahn stage comprises surface irregularities for providing improved fluid pumping, relative movement of said fixed and static plates causing a change in pumping performance as a relative contribution of said faces to said pumping performance changes Surface irregularities may be provided in the surfaces of the plates or disks for improving the pumping efficiency. Irregularities may be on the fixed or rotating plates. Changing the relative positions of the plates to each other changes their contribution to the pumping process and thus, where their contribution is different due to the presence or absence of surface irregularities the overall pumping capacity can be controlled in this way.

In some embodiments, at least two faces of said plates of said Siegbahn stage comprise surface irregularities for providing improved fluid pumping, at least one of said at least two faces facing in one direction and at least one other of said at least two faces facing in the other direction, the surface irregularities on the at least one face facing in one direction being different to the surface irregularities on the at least one face facing in the opposite direction, relative movement of said fixed and static plates causing a change in pumping performance as a relative contribution of said faces to said pumping performance changes.

As the plates move relative to each other, then the relative contribution of a plate to the pumping performance will change and where plates have different irregularities and thus, different contributions to the pumping performance, changing the position of the fixed and rotating plates relative to each other changes their contribution to the pumping process and changes pumping capacity. Providing different surface irregularities provides an effective and predictable means of pumping capacity control where relative axial movement between stator and rotor switches between pumping arrangement where different plates provide the major contribution to the pumping capacity. Having different surface irregularities on the different plates means that the change in their contribution changes the overall pumping capacity.

In some embodiments, said surface irregularities on said at least one face facing in said one direction and on said at least one face facing in said opposite direction have at least one of a different size and a different form.

Where the surface irregularities are on the rotating plate for example, then the irregularities on a face facing one way may be different to those on the face facing the other way. As the rotating plate moves in one axial direction one surface moves closer to a fixed plate, while the other surface moves further from another fixed plate. Thus, the contribution of each face is changed and control of the pumping capacity can be achieved.

In some embodiments, said surface irregularities on one side of said plate are more than 10% larger than surface irregularities on the other side.

The irregularities may be longer, deeper and/or wider.

Although the irregularities may have a number of forms in some embodiments, said surface irregularities comprise grooves.

In some embodiments, said control circuitry comprises an input configured to receive a signal indicative of a pressure produced by said vacuum pump, said control circuitry being configured to control said axial position of said rotor plate in dependence upon a value of said signal.

As the longitudinal positon of the rotor plate can be used to control the inlet conductance and thus, the pressure produced by the vacuum pump, the control circuitry may in some cases use a feedback loop and a signal received from a sensor indicating a pressure produced by the pump to provide effective control of the pressure. Where the pump is pumping a vacuum chamber this may be a pressure measured in the chamber, perhaps adjacent to baffles within the chamber for providing uniform pressure over a wafer, or perhaps adjacent or at the pump inlet. In some cases a feedforward loop may be used with a desired pressure being equated to a particular axial position. The relative axial positions are initially set to the value related to the desired pressure and the axial position is tweaked if required in response to readings from the pressure sensor. Where some tweaking is needed an updated axial positon is stored for that pressure.

A second aspect provides a vacuum arrangement comprising a vacuum chamber outlet and a vacuum pump according to a first aspect, the vacuum pump inlet being connected to the vacuum chamber outlet.

The vacuum pump may be connected to the outlet of a vacuum chamber. The outlet may be part of the vacuum chamber itself or it may be a separate component that can be assembled to form the vacuum chamber, it may for example, be a part of the base of the vacuum chamber.

In some embodiments, said vacuum pump comprises a vacuum pump according to a first aspect, and said control circuitry is configured to control said axial position of said rotor plate by changing an axial position of said vacuum pump relative to said outlet for said vacuum chamber.

Where the pump is connected to the outlet of the chamber then the relative axial position of the rotor plate to the pump inlet and/or chamber outlet controls the inlet conductance for the pump. In such a case, the axial position of this plate relative to the chamber outlet can be controlled by moving the whole pump relative to this outlet. Alternatively, the rotor plate's relative position to the pump inlet and chamber outlet can be controlled by changing an axial position of the rotor of the pump relative to the stator.

In some embodiments, the vacuum arrangement further comprises a valve plate mounted on a different side of said vacuum chamber outlet to said pump, said rotor plate and valve plate being configured for relative axial movement between an open position where gas can pass from a vacuum chamber into said pump and a closed position where said valve plate completely obscures a least one of said chamber outlet and pump inlet and gas cannot pass from said vacuum chamber to said pump.

In some cases there may be a valve associated with the chamber outlet and in such a case there may be a valve plate mounted on the other side of the vacuum chamber outlet to the pump. Relative axial movement between the rotor plate and valve plate opens and closes the pump inlet. In this regard, the relative movement may be provided by the valve plate moving relative to the chamber outlet and opening or closing it and/or it may be provided by the pump itself moving relative to the chamber outlet and abutting the valve plate or leaving a gap between the valve plate and the pump inlet.

In some embodiments, said rotor plate is operable to move axially with respect to said valve plate to partially obscure said pump inlet by varying amounts and thereby vary said inlet conductance.

The opening and closing of the pump inlet/chamber outlet may be provided by the valve plate and the pump inlet or chamber outlet abutting each other; however the variation in inlet conductance may be provided by a movement of the rotor plate which partially obscures the inlet by varying amounts. This varying inlet conductance provides control of the pressure produced by the pump within the chamber.

In some embodiments, said valve plate comprises a recess and said rotor plate is sized to fit within said recess.

In order to provide a wide range of inlet conductance it may be advantageous if the valve plate has a recess into which the rotor plate can fit during its axial movement. In this way, when it fits within the recess the inlet conductance is at a maximum and when it moves out of the recess and partially obscures the pump inlet/chamber outlet then the inlet conductance is reduced.

Furthermore, allowing the rotor plate to fit within the valve plate allows the valve plate and pump inlet or chamber outlet to abut in some axial positions and isolate the chamber from the pump.

In some embodiments, the valve arrangement comprises a seal for sealing between said valve plate and at least one of a vacuum chamber outlet wall and a wall of said pump inlet.

As the rotor plate will be rotating with the rotor then it may not be practical to provide a seal on the rotor plate. However, where there is a valve plate and movement either of the valve plate or of the whole pump allows surfaces of the valve and pump inlet or chamber outlet to abut then a seal such as an O-ring may be provided between these walls to effectively isolate the pump and the chamber from each other. In other embodiments no seal may be provided.

In some embodiments, the vacuum arrangement further comprises the vacuum chamber comprising the vacuum chamber outlet.

A third aspect provides a vacuum pump arrangement according to a second aspect and further comprising a backing pump; said backing pump comprising an inlet; said vacuum pump arrangement comprising a controllable valve arrangement configured to either connect said inlet of said backing pump to said vacuum chamber or to connect said inlet of said backing pump to an exhaust of said turbo pump and said inlet of said turbo pump to said chamber.

An alternative and/or additional way of changing the pressure in a vacuum chamber is to provide valve arrangements that allow a backing pump which may in some embodiments be a drag pump to be connected to the chamber in one position of a valve or in another position of a valve to act as a backing pump to back the turbo stage. Where the hacking pump is mounted on a different shaft to the turbo pump it may be made of different materials and be able to withstand higher temperatures and more aggressive chemicals. In this way a pump is provided that is suitable for use evacuating a chamber that may house different processes with different chemicals and pressure requirements. Furthermore, providing a valve mechanism able to switch between the two pumps provides an extremely fast and effective way of switching between very different pressures. This may be advantageous in process environments where the requirements of the process and chemicals being pumped changes.

A fourth aspect of the present invention provides a method of controlling a pumping capacity of a vacuum pump according to a first aspect comprising: setting an axial position of said rotor plate in dependence upon a required inlet conductance; operating the vacuum pump; determining a change of inlet conductance is required; and setting a new axial position of said rotor plate to provide a new required inlet conductance.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided.

Embodiments provide a vacuum pump where a disc or plate has been added to the top of a pump's rotor for example a turbo rotor, the disc being raised or lowered to provide fine pressure control by altering the inlet conductance via the radial gap around the disc. Embodiments may use the magnetic bearing control already provided in some pumps to control the axial position or height of the disc. Where there is a regenerative and/or drag stage such as a Siegbahn stage mounted on the same spindle as the turbo stage raising/lowering the rotor affects the pumping speed/capacity of the drag/regenerative stage and can be used in conjunction with changes in the disc position to control pumping capacity.

In some embodiments rather than raising and lowering the rotor to change the axial position of the disc, the whole pump may be raised and lowered with respect to the chamber, whereby the rotor plate can replace the action of the pressure control valve. Inclusion of an O-ring may provide additional sealing. Providing pressure control by changing the axial position of a rotor plate and in some cases, the whole rotor allows additional valve components conventionally used for this to be replaced and thereby reduces the height of the installed pump and eliminates or at least reduces a source of particle shedding.

The use of a valve plate mounted on the rotor in this way provides a valve with symmetrical flow around the valve reducing non-uniformities in gas flow in the chamber.

In the above and in the following text, for convenience it is assumed that the pumps are orientated so that the spindle is vertical—in practice pumps can be orientated in any axis, such that where lowering and raising are discussed, this can be equated to changing an axial position, that is moving along an axis running parallel to the shaft of the pump.

Figure 1:
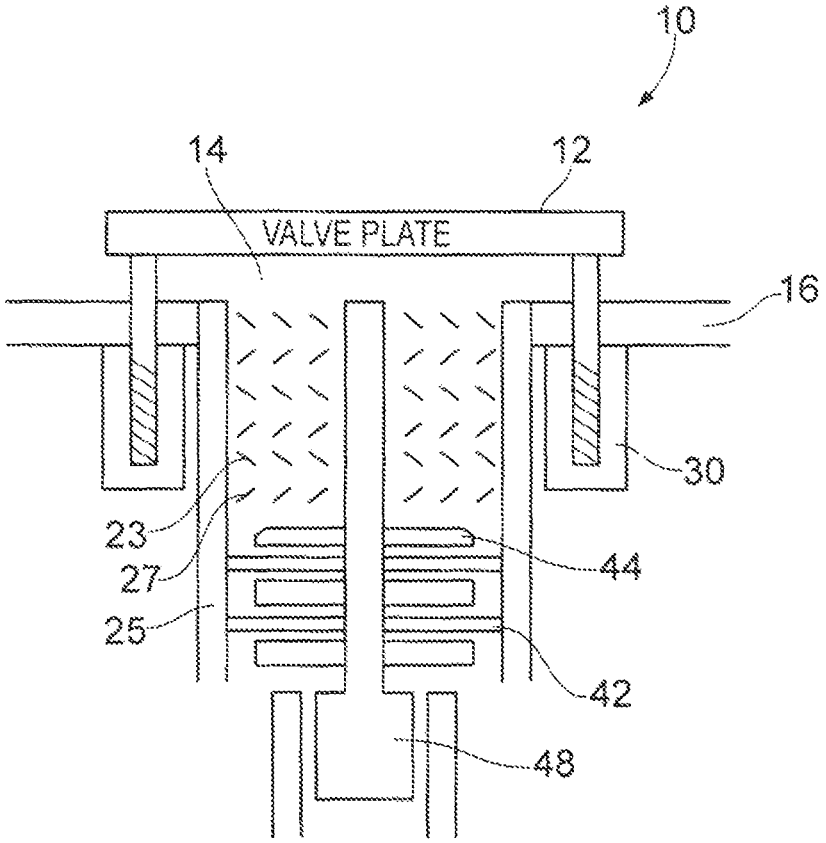
FIG. 1 shows a vacuum pump according to the prior art.

FIG. 1 shows a conventional vacuum pump with a turbo and drag stage for evacuating a vacuum chamber 10. There is a valve plate 12 for controlling pressure in the chamber. In this embodiment the chamber outlet 14 and pressure control valve 12 are placed directly under the centre of the wafer (not shown). This helps improve the flow symmetry seen around the circumference of the wafer. Raising and lowering of the valve plate 12 causes the chamber to be isolated or in fluid communication with the pump.

Figure 2:
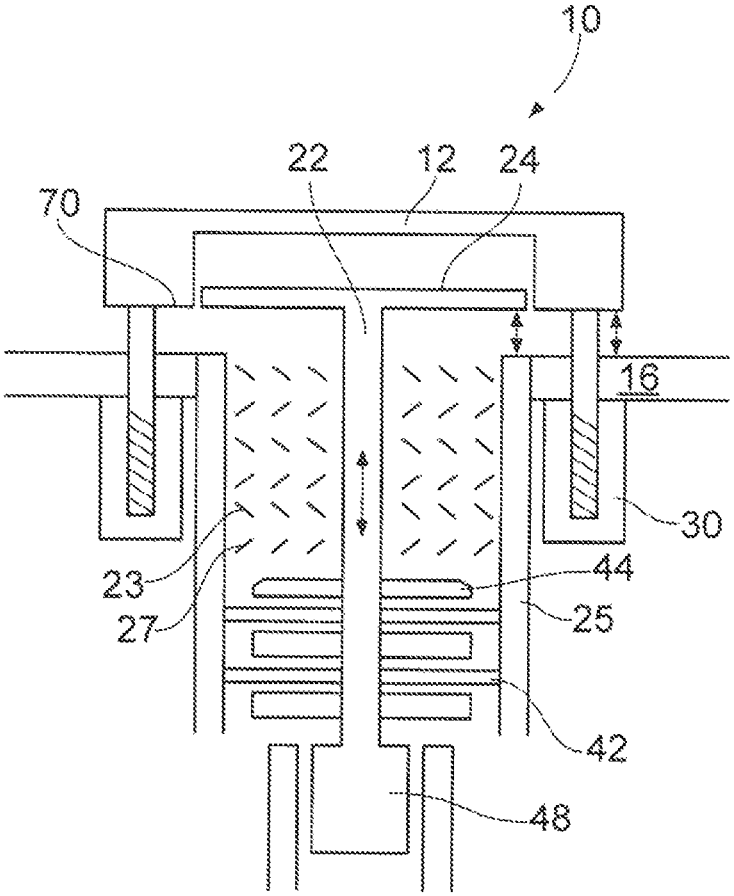
FIG. 2 shows a vacuum pump comprising a turbo and drag stage according to an embodiment.

FIG. 2 shows a vacuum pump according to an embodiment. In this embodiment the rotor 22 has a rotor plate 24 affixed to the upper end. The rotor 22 is magnetically levitated via magnetic spindle hearings 48 and control circuitry (not shown) in conjunction with the magnetic levitation system is used to control the vertical position of the rotor and thus, the position of the rotor plate 24 and to effect a rapid change in inlet conductance and thus, performance of the pump. The range of vertical movement available will depend on the magnetic design of the bearing, and the mechanical limitations of turbo blade clearance and where there is a Siegbahn drag stage the Seigbahn clearance and performance characteristics.

The valve plate 12 has been provided with a recess into which the rotor plate 24 can fit. In the embodiment of FIG. 2, both the valve plate 12 and rotor plate 24 are mounted for vertical movement, such that the valve plate 12 may be used to close the inlet and provide a seal via O-ring seal 70 and vacuum chamber floor 16, and provide gross pressure change, while the rotor plate 24 is used to vary the inlet conductance and provide finer pressure change. The valve plate's vertical position may be changed using actuator 30, while the rotor may move vertically by control of the magnetic bearings. Although not shown the rotor plate may have surface irregularities on its lower surface for deflecting particles into the pump inlet as it rotates.

In this embodiment variation in the axial position of the rotor 22 relative to the stator 25 changes both the inlet conductance due to the rotor plate obscuring the pump inlet to varying degrees, and changes the pumping capacity of the pump by changing the performance of the Siegbahn stage.

In this regard, turbo performance is relatively insensitive to the clearance between rotating and static blades. The clearance is there to avoid physical clashes between rotor blades 23 and stator blades 27.

Drag stages can include Siegbahn and/or Holweck types. Whereas Holweck is essentially a cylinder in a cylinder and insensitive to the vertical relationship between rotor and stator, the Siegbahn drag mechanism is a plate 44 rotating above a static plate 42 and performance is very sensitive to vertical clearance.

In this case, varying the Siegbahn clearance by varying the height of the rotor 22 will affect the backing pressure of the turbo stages and, depending on species and pressure, will affect the pumping speed. Thus, a pump with both a rotor plate 24 and a stage where pumping performance is sensitive to the relative axial position of the rotor 22 and stator 25 allows effective and rapid pressure control to be provided by varying the relative axial position of these components.

In some embodiments, at least some of the surfaces of the Siegbahn discs have surface irregularities such as grooves which may improve the efficiency of the pumping action. In some cases these may be different on different surfaces and this can amplify the effect on the pumping capacity of axial movement of the rotor.

In some cases surfaces on the discs on either the rotor or stator facing in one direction may have the same surface irregularities while those facing in the other direction may have different surface irregularities.

In summary the benefits of the above pump design include rapid pressure change in some cases without moving anything that was not already moving. This can eliminate a source of particle shedding.

Figure 3:
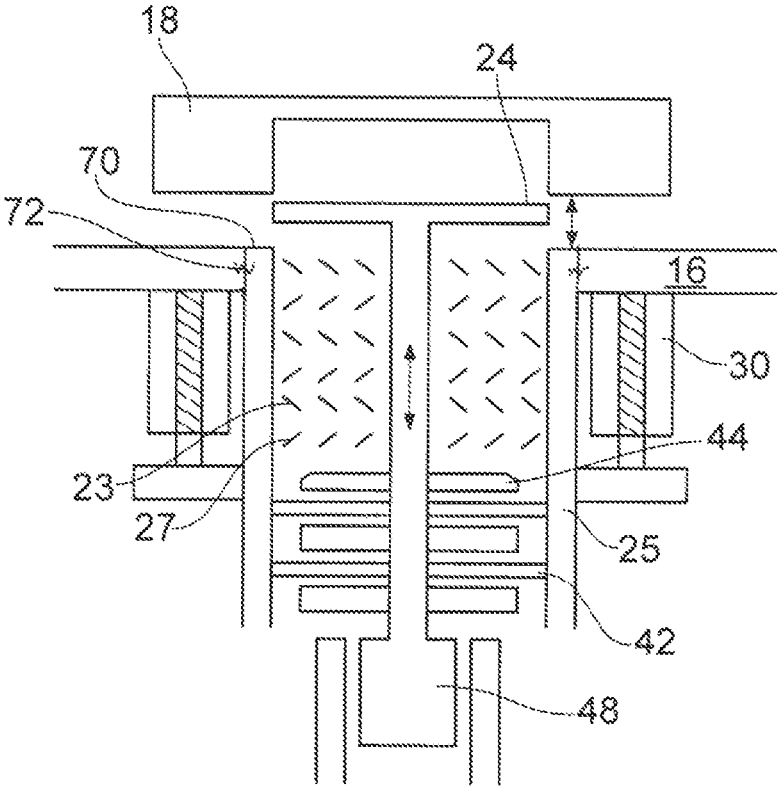
FIG. 3 shows a vacuum pump comprising a turbo and drag stage according to a further embodiment.

In an alternative embodiment shown in FIG. 3, which can be used in conjunction with either or both of the above, the whole turbo pump is moved vertically relative to the chamber using actuator 30 to vary the conductance and hence performance. In this case the turbo body could incorporate the O-ring seal 70 for isolation. In this case fixed sample mounting means 18 has a recess for the rotor plate 24.

Advantages of these arrangements are a reduced height of the total package. There may be reduced flutter of the valve plate and reduced cost and improved stability due to the elimination of an interface.

Challenges may include the need for relatively powerful actuators to move the pump, some kind of bellows seal 72 may be needed between the chamber body and the turbo body. Furthermore the combination of the bellows and the jacking system may need to be capable of withstanding the crash torque of the pump.

Figure 4:
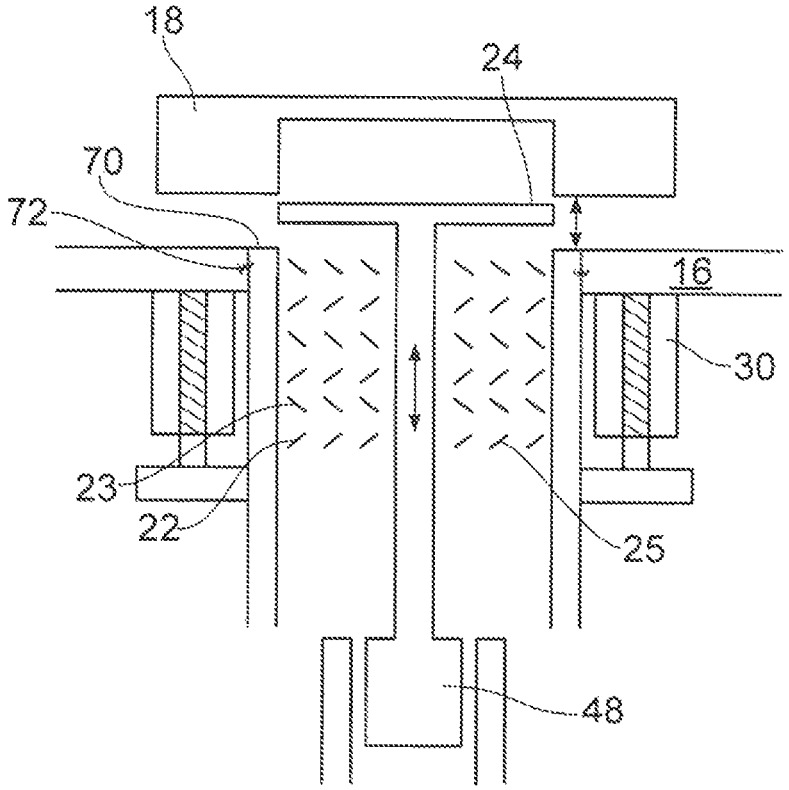
FIG. 4 shows a turbo pump according to an embodiment.

FIG. 4 shows an alternative embodiment, where the pump is a turbo pump with no drag stage on the same spindle. In this case any axial movement of the rotor affects only the pump inlet conductance and this may make the effects easier to predict. In this case there is a bellows seal between the pump and chamber and an O-ring seal at the edge of the pump inlet that is configured to mate with the plate 12 which in this embodiment is fixed. The pump moves up and down in response to actuator 30 to provide gross control of the inlet conductance and to seal the chamber. In some embodiments the rotor may also move axially for fine control of the inlet conductance.

Figure 5:
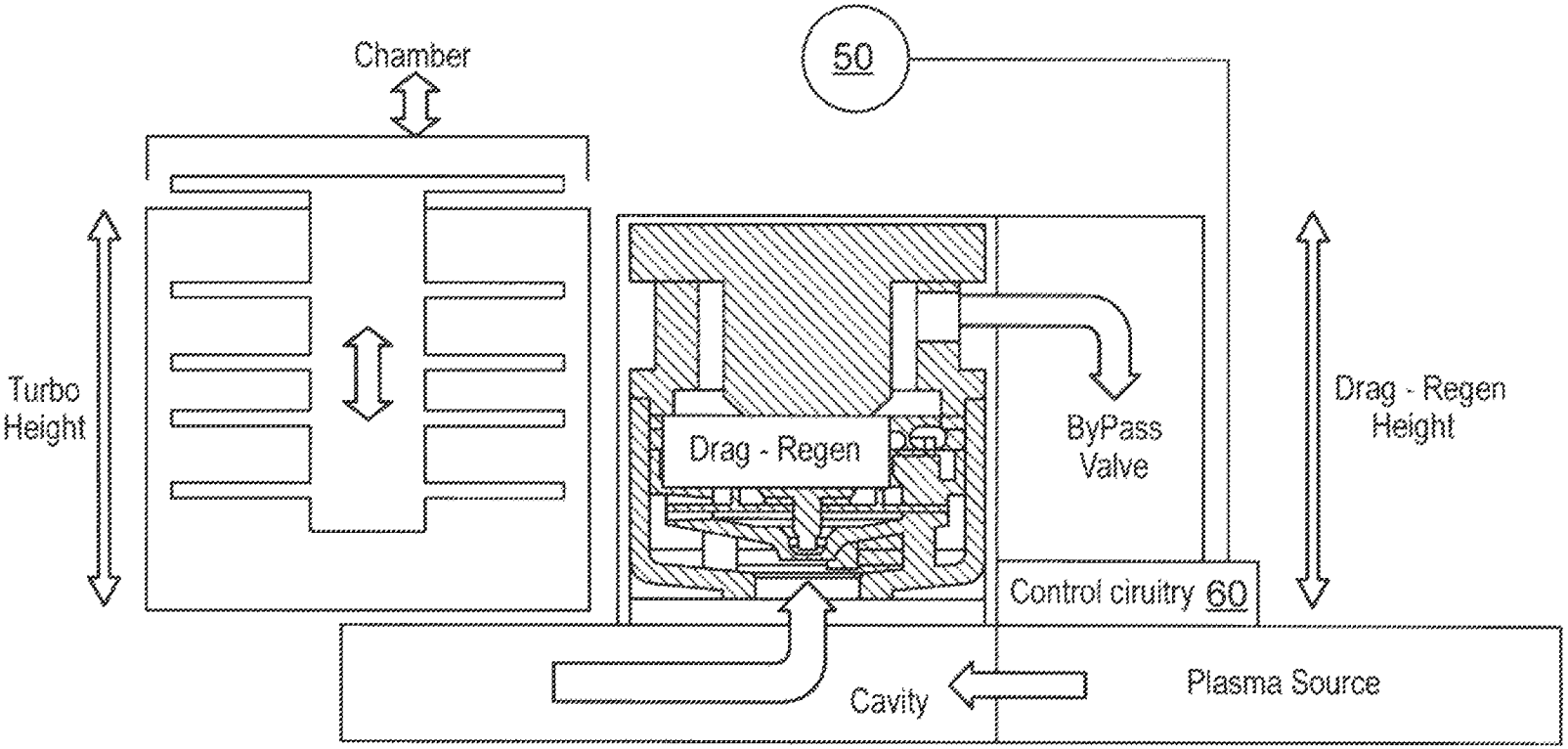
FIG. 5 shows a turbo vacuum pump and a drag vacuum pump mounted on different spindles according to an embodiment.

FIG. 5 shows a further embodiment where the turbo stage is on a different spindle from the drag stage. In this case the turbo spindle height can be varied independently of the drag spindle—thereby controlling inlet conductance independently of backing pressure. Furthermore, the arrangement allows the total height of the pump to be significantly reduced.

The traditional configuration includes drag stages and potentially regen stages on the same spindle as the turbo stages. Splitting the turbo and drag stages not only allows independent control of the axial position of the two rotors, but it allows them to be formed of different materials.

In the embodiment of FIG. 5, the turbo may be used in conjunction with the rotor plate and valve plate to seal the chamber and the drag stage is used to back the turbo pump.

The axial movement of the rotor plate can be done by the turbo part of the pump being jacked vertically—there being a flexible connection to the drag stage which would be fixed relative to the chamber. This would reduce the mass of the unit to be jacked up and down and would reduce the crash torque which the mounting system would need to withstand.

Alternatively the turbo and drag parts could be fixed together and jacked up and down together—then the drag part would additional leverage to a mounting system to withstand crash torque.

In some embodiments a plasma source is provided for injecting radicals into the interstage.

Control circuitry 60 is provided for controlling the relative axial position of the rotor of the turbo pump and thereby the inlet conductance. The control circuitry receives signals from a pressure sensor 50 allowing it to vary the turbo rotor's axial position and thereby the inlet conductance to the chamber to achieve a desired pressure in the chamber.

Figure 6:
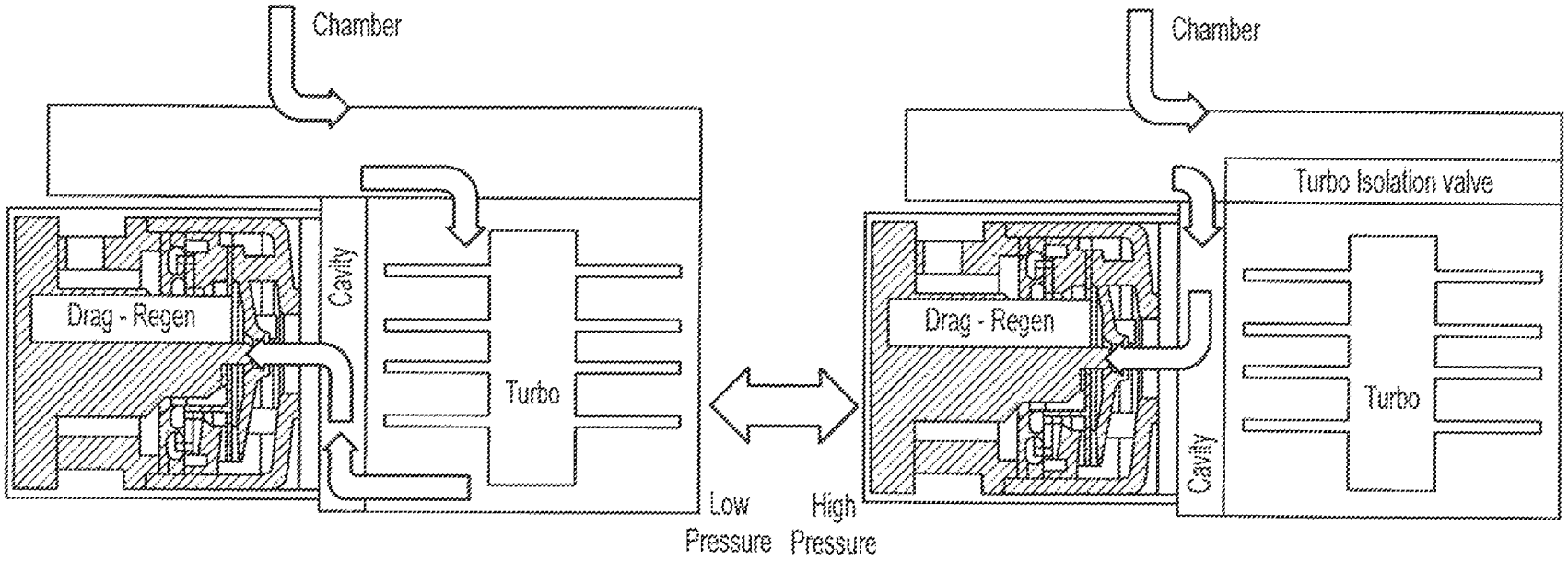
FIG. 6 shows a turbo vacuum pump and a drag vacuum pump mounted on different spindles according to a further embodiment.

FIG. 6 shows a further example of a pump. In this example the turbo and drag stage are again mounted on different spindles. In this case there is a pendulum valve that allows the chamber to be connected to either the turbo pump which in this case is backed by the drag pump, or directly to the drag pump.

In high pressure operation the turbo pump is sealed by a turbo isolation valve which may comprise a valve plate acting in conjunction with a rotor plate.

In lower pressure operation where a higher vacuum is required the drag pump is connected to the exhaust of the turbo pump and the combined pump is used to pump the chamber to a high vacuum, control of pressure within the chamber being achieved by axial movement of the rotor of the drag stage and in some cases axial movement of the rotor plate on the turbo pump.

Allowing the drag stage to be used on its own to pump the chamber where a lower vacuum is required may be advantageous where aggressive or hot fluids are being pumped such as during a cleaning cycle. As the drag stage is mounted on a separate spindle it can be made of different materials to the turbo stage and these materials maybe selected to be more resistant to high temperatures and aggressive chemicals. Furthermore, rapid pressure changes may be achieved by switching between the two arrangements using a valve such as a pendulum valve. Switching times of 0.2 seconds or lower may be achieved. Finer pressure control can be achieved by varying the axial position of the rotor of the drag stage and/or the rotor plate of the turbo stage.

In summary, FIG. 6 provides split flow/differential pumping to provide more than one inlet into the pump giving more than one pressure point. Each inlet can be valved separately to switch from one performance point to the other quickly.

In all of the above, the control of pump speed and pressure control, together with pump temperature and the control of any plasma source can be handled by a single controller.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

The invention claimed is:

1. A vacuum pump comprising:

at least one rotor; and a stator, an inlet for receiving gas during operation; and an exhaust for exhausting said gas; wherein said vacuum pump comprises a shaft extending through said pump and comprising a plate mounted on an end of said shaft towards said inlet;

said vacuum pump comprising control circuitry configured to control an axial position of said plate, a change in axial position of said plate providing a change in inlet conductance of gas to said vacuum pump; wherein said plate is mounted such that it extends beyond said inlet in at least some axial positions of said shaft such that said plate is not on the same side of said inlet as said stator, wherein said shaft comprises a rotor shaft, said plate comprising a rotor plate configured to rotate with said rotor.

2. The vacuum pump according to claim 1, wherein said plate is configured to close said inlet at a predefined axial position.

3. The vacuum pump according to claim 1, said rotor plate comprising surface irregularities on a surface facing towards said inlet, said surface irregularities being configured to divert at least some particles within said gas towards said inlet.

4. The vacuum pump according to claim 1, wherein said vacuum pump comprises a turbo pump.

5. The vacuum pump according to claim 4, wherein said vacuum pump comprises a turbo pump stage backed by at least one further stage.

6. The vacuum pump according to claim 5, wherein said at least one further stage comprises at least one of a drag and a regenerative stage.

7. The vacuum pump according to claim 5, wherein said at least one further stage comprises a Siegbahn stage, said rotor comprising at least one rotating plate and said stator comprising at least one fixed plate, a distance between said at least one rotating plate and said at least one fixed plate being dependent upon said relative axial position of said stator to said rotor.

8. The vacuum pump according to claim 5, wherein said turbo pump stage and said at least one further stage are mounted on the rotor shaft.

9. The vacuum pump according to claim 5, wherein said turbo pump stage and said at least one further stage are mounted on different shafts.

10. The vacuum pump according to claim 1, wherein said rotor and stator are mounted to be movable in an axial direction with respect to each other.

11. The vacuum pump according to claim 10, wherein said rotor is positioned within said vacuum pump via electromagnetic bearings, and said control circuitry is configured to control an axial position of said rotor by controlling a current supplied to electro-magnets associated with said bearings.

12. The vacuum pump according to claim 1, wherein said control circuitry comprises an input configured to receive a signal indicative of a pressure produced by said vacuum pump, said control circuitry being configured to control a relative axial position of said rotor and said stator in dependence upon a value of said signal.

13. A vacuum arrangement comprising an outlet of a vacuum chamber and a vacuum pump according to claim 1, said vacuum pump inlet being connected to said outlet of said vacuum chamber.

14. The vacuum arrangement according to claim 13, said vacuum pump inlet being connected to said outlet of said vacuum chamber, wherein said control circuitry is configured to control said axial position of said plate by changing an axial position of said vacuum pump relative to said outlet of said vacuum chamber.

15. The vacuum arrangement according to claim 13, further comprising a valve plate mounted on a different side of said vacuum chamber outlet than said stator of said vacuum pump, said plate and valve plate being configured for relative axial movement between an open position where gas can pass from said vacuum chamber into said vacuum pump and a closed position where said valve plate completely obscures at least one of said chamber outlet and said pump inlet such that gas cannot pass from said vacuum chamber to said vacuum pump.

16. The vacuum arrangement according to claim 15, wherein said control circuitry is configured to control said axial position of said plate by changing an axial position of said vacuum pump relative to said outlet of said vacuum chamber and said valve plate comprises a recess and said plate is sized to fit within said recess.

17. The vacuum arrangement according to claim 13, wherein said plate is operable to move axially with respect to said chamber outlet to partially obscure said pump inlet by varying amounts and thereby vary said inlet conductance.

18. A method of controlling a pumping capacity of a vacuum pump according claim 1, said method comprising:

setting an axial position of said plate in dependence upon a required inlet conductance;

operating the vacuum pump;

determining a change of inlet conductance is required; and setting a new axial position of said plate to provide a new required inlet conductance.

* * * * *